US006263742B1

(12) United States Patent
Gruson et al.

(10) Patent No.: US 6,263,742 B1
(45) Date of Patent: Jul. 24, 2001

(54) METHOD OF CONTROLLING A SCREWING SPINDLE

(75) Inventors: Bertrand Gruson, Breville sur Mer; Gérard Ovieve, Colombes, both of (FR)

(73) Assignee: Serac Group, La Ferte Benard (FR)

( * ) Notice: Subject to any disclaimer, the term of this patent is extended or adjusted under 35 U.S.C. 154(b) by 0 days.

(21) Appl. No.: 09/192,428

(22) Filed: Nov. 16, 1998

(30) Foreign Application Priority Data

Nov. 17, 1997 (FR) ..... 97 14364

(51) Int. Cl.[7] ..... B25B 23/14
(52) U.S. Cl. ..... 73/862.23; 173/181
(58) Field of Search ..... 73/761, 862.23; 173/180, 181

(56) References Cited

U.S. PATENT DOCUMENTS 3,593,830 * 7/1971 Clapp et al. ..... 477/178
3,866,463 2/1975 Smith et al. .
3,939,920 * 2/1976 Hardiman ..... 73/761
4,026,369 * 5/1977 Vliet ..... 173/183
4,418,765 * 12/1983 Mori et al. ..... 173/182
4,620,450 * 11/1986 Yamaguchi ..... 73/862.23
5,129,465 * 7/1992 Rahm ..... 173/178
5,167,309 * 12/1992 Albert et al. ..... 477/178
5,567,886 * 10/1996 Kettner ..... 73/862.23
5,617,924 * 4/1997 Baron et al. ..... 173/181

FOREIGN PATENT DOCUMENTS 637600 8/1983 (CH) .

* cited by examiner

*Primary Examiner*—Max Noori

(57) ABSTRACT

A method of controlling a screwing spindle comprising a fluid-fed motor and having a drive member connected to a spindle shaft to rotate it, the method comprising the step of feeding the screwing spindle under nominal conditions of pressure and flow rate that generate a required tightening torque, and a prior step during which the screwing spindle is fed under conditions that are weaker than the nominal conditions by a ratio that is sufficient to ensure that the spindle shaft has a speed of rotation that generates kinetic energy producing a torque that is less than the required tightening torque.

8 Claims, 2 Drawing Sheets

METHOD OF CONTROLLING A SCREWING SPINDLE

The present invention relates to a method of controlling a screwing spindle of the kind used for screwing stoppers onto packages having threaded necks.

BACKGROUND OF THE INVENTION

Screwing spindles are known that have a linear actuator with a piston connected to a spindle shaft to rotate it. A method commonly used for controlling such spindles consists in subjecting the piston to differential tightening pressure, thereby generating the required torque for tightening the stopper on the neck of the package. A problem comes from the fact that when the stopper begins to be screwed on, there is little friction between the stopper and the neck, such that there is little opposition to rotation of the spindle. The spindle shaft thus acquires a high speed of rotation, and because of its inertia the spindle shaft stores a considerable amount of kinetic energy. The kinetic energy stored in this way causes the stopper to be tightened quickly until it comes into abutment, at which point the spindle shaft is caused to stop suddenly. On stopping, the stored kinetic energy is restored in the form of a dynamic torque which is applied to the stopper and which is greater than the required tightening torque. This dynamic torque can damage the stopper or the neck of the package, and it can make it necessary for a user of the package to have recourse to a tool for loosening the stopper.

OBJECTS AND SUMMARY OF THE INVENTION

An object of the invention is to propose a method of controlling a screwing spindle in a manner that enables the required tightening torque to be obtained accurately.

According to the invention, this object is achieved by providing a method of controlling a screwing spindle, the method comprising a step of feeding the screwing spindle with fluid under nominal conditions of pressure and flow rate for generating a required tightening torque, and a prior step during which the screwing spindle is fed under conditions that are weaker than nominal by an amount that is sufficient to ensure that the spindle has a speed of rotation that cannot generate kinetic energy capable of producing a torque that is greater than the required tightening torque.

In particular, with a linear actuator including a piston, the piston is subjected during the prior step to mean differential pressure that is lower than the tightening differential pressure.

Thus, the mean differential pressure serves to rotate the spindle shaft at low speed only, thereby causing little kinetic energy to be accumulated. By the time tightening pressure is applied to the piston, the torque opposing tightening is sufficient to prevent any increase in the speed of rotation of the spindle, such that the stopper comes to rest as soon as the opposing torque is equal to the driving torque which corresponds to the tightening pressure. Kinetic energy is therefore not restored suddenly, so the tightening torque as actually applied to the stopper is indeed equal to the required tightening torque.

In a first implementation of the invention, during the prior step, one face of the piston is subjected in the tightening direction to a constant pressure that is lower than the differential tightening pressure.

Two different pressures are used. Thus, once the tightening operation has been completed, the constant pressure that is lower than the tightening pressure can be used to return the actuator, thereby achieving significant fluid savings.

In a second implementation, the piston is subjected to constant pressure in the tightening direction, and also to a counter-pressure.

The mean differential pressure is then equal to the difference between the constant pressure applied to the face of the piston and the counter-pressure. The constant pressure is preferably equal to the tightening pressure. A single pressure level corresponding to the required tightening torque is then required, and this simplifies regulating the pressure of the fluid fed to the actuator.

In a third implementation, the piston is subjected intermittently to pressure at a constant value.

In this way, the spindle is set into rotation by pressure being applied thereto, and its kinetic energy is restored while pressure is not being applied thereto, thereby making it possible to control the speed of the spindle by acting on the pressure-on times and on the pressure-off times.

In this variant, it is advantageous for the differential pressure to have a value that is constant and equal to the tightening pressure.

As in the preceding case, only one pressure level is used, and it corresponds to the required tightening torque, thereby simplifying regulation of the feed fluid pressure.

Other characteristics and advantages of the invention appear on reading the following description of particular, non-limiting variants of the invention.

BRIEF DESCRIPTION OF THE DRAWINGS

Reference is made to the accompanying drawings, in which.

MORE DETAILED DESCRIPTION

Figure 1:
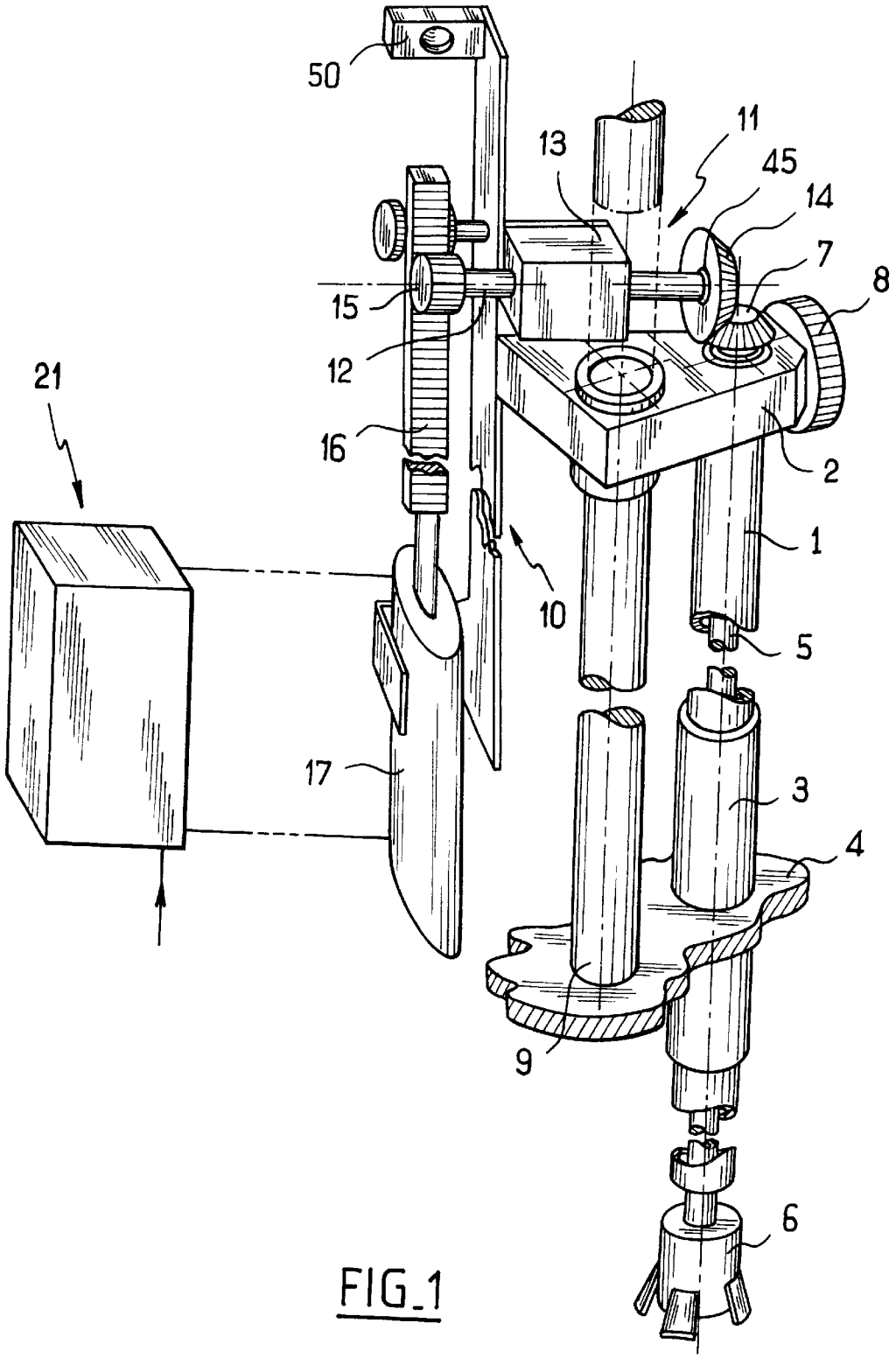
FIG. 1 is a fragmentary perspective view of a tightening spindle.

With reference to the figures, the tightening spindle controlled by the method of the invention is conventional in structure and operation, and certain elements thereof are not shown. In the embodiment that is shown, the spindle comprises a vertical guide tube 1 fixed to a spindle support 2 and sliding vertically in a sleeve 3 secured to a rotary platform 4. The tube 1 rotatably receives a spindle shaft 5 whose bottom end projects beyond the tube 1 and carries a stopper-engaging jawed chuck device 6. The top end of the spindle shaft 5 carries a conical gear wheel 7 co-operating with a drive assembly given overall reference 1.

The spindle support 2 is mounted to slide on a column 9 fixed to the rotary platform 4 and it carries a wheel 8 designed to co-operate with a cam of a stationary structure for positioning the support 2 and the parts associated therewith in the vertical direction.

A support plate 10 is fixed on the side of the spindle support 2 and carries the drive assembly 11.

The drive assembly 11 comprises an intermediate shaft 12 mounted to rotate in a bearing 13 carried by the support plate 10. The shaft 12 has one end carrying a conical deflector gear wheel 14 via a free-wheel unit 45, with the teeth of the conical gear wheel 14 meshing with those of the gear wheel 7, and it has an opposite end carrying an inlet gear wheel 15 whose teeth mesh with those of a rack 16. The rack 16 has its bottom end fixed to the rod of an actuator 17 whose cylinder is fixed to the support plate 10.

In conventional manner, the actuator 17 has a piston 18 mounted to slide in the cylinder of the actuator and to subdivide the inside thereof into two chambers 19 and 20. The actuator 17 is connected to a control member given overall reference 21. It will be understood that in this type of installation, the torque applied to the spindle when it is prevented from rotating depends directly on the differential pressure to which the piston 18 is subjected.

Figure 2:
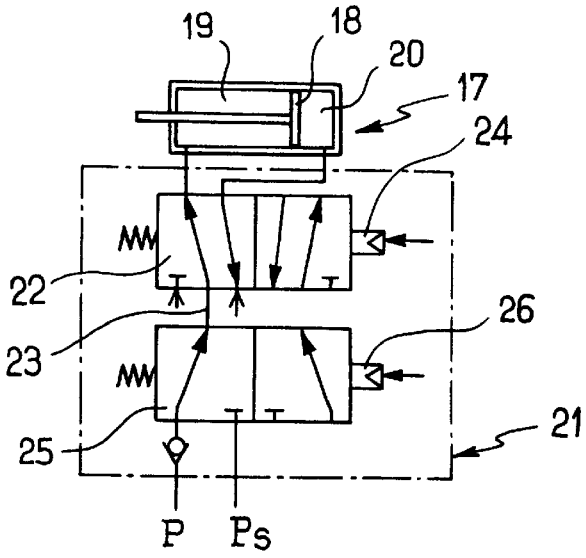
FIGS. 2, 3, and 4 are diagrams of the spindle control members corresponding to three implementations of the method of the invention.

With reference more particularly to FIG. 2, and in a first implementation of the invention, the control member 21 comprises a monostable valve 22 controlled by a control inlet 24 to move between a tightening position in which the chamber 19 is connected to exhaust while the chamber 20 is connected to a feed inlet 23, and a return position in which the chamber 19 of the actuator 17 is put into communication with the feed inlet 23 of the valve 22 while the chamber 20 is connected to exhaust. The control inlet 24 is connected to a first sensor (not shown) for sensing the position of the screwing spindle relative to the fixed structure.

A monostable valve 25 is placed between the feed inlet 23 and two sources of air under pressure, one source of air at tightening pressure PS corresponding to the required tightening torque, and another source of air at a pressure P that is lower than the pressure PS. The valve 25 is controlled by a control input 26 to move between a low pressure feed position in which the pressure source P is connected to the feed inlet 23 while the pressure source PS is shut off, and a tightening pressure feed position in which the pressure source P is shut off while the pressure source PS is connected to the feed inlet 23. The control inlet 26 is connected to a second sensor for sensing the position of the tightening spindle relative to the fixed structure.

In operation, the platform 4 is rotated relative to the fixed structure by a motor. Packages having threaded necks are fed successively thereto and are held vertically beneath the chuck device 6 which has previously been fitted with a stopper.

When the spindle goes through a first position relative to the structure, the control inlet 24 of the valve 22 causes the valve 22 to be brought into the tightening position, while the valve 25 remains in the low-pressure feed position. Air at pressure P is then fed into the chamber 20 of the actuator 17 and acts on the corresponding face of the piston. The rod of the actuator 17 pushes the rack 16 upwards. The rack 16 rotates the inlet gear wheel 15 which transmits its motion to the chuck device 6 via the shaft 12, the gear wheels 14 and 7, and the spindle shaft 5 pivoting in the guide tube 1. It should be observed that the pressure P is smaller than the tightening pressure PS in a ratio that is sufficient to ensure that the speed of rotation of the spindle shaft 5 gives rise to kinetic energy that cannot produce torque greater than the required tightening torque.

During screwing, the spindle continues to move relative to the structure because the platform 4 is rotating. As the spindle goes through a second position relative to the structure, e.g. corresponding to the end of stopper screwing, i.e. a position in which the stopper has come into abutment against the neck of the bottle, the valve 25 is moved via its control inlet 26 into its position for feeding at the tightening pressure. Air at tightening pressure PS is then admitted into the chamber 20. It will be observed that the second position which determines when the chamber 20 begins to be fed with air at the tightening pressure PS is defined so that the torque then opposing tightening of the stopper on the threaded neck is sufficient to prevent the speed of rotation of the spindle shaft 5 under drive from the tightening pressure increasing so as to generate kinetic energy that is sufficient to produce tightening torque greater than the required tightening torque.

Once the tightening of the stopper on the neck gives rise to an opposing torque of value equal to that of the driving torque, the spindle shaft 5 stops rotating and the rack 16 becomes stationary.

When the spindle is in a third position corresponding to the end of the screwing cycle, the valve 25 is returned to its low pressure feed position and the valve 22 is returned to its return position. Air at pressure P is then admitted into the chamber 19 of the actuator 17 so that the actuator retracts. The free-wheel unit 45 associated with the gear wheel 14 allows the actuator to retract without unscrewing the stopper. Once the actuator has retracted, the chuck device 6 can be released without damaging the stopper and the screwing spindle is then ready for a new cycle.

Elements identical or analogous to those described above are given the same numerical references in the description below.

Figure 3:
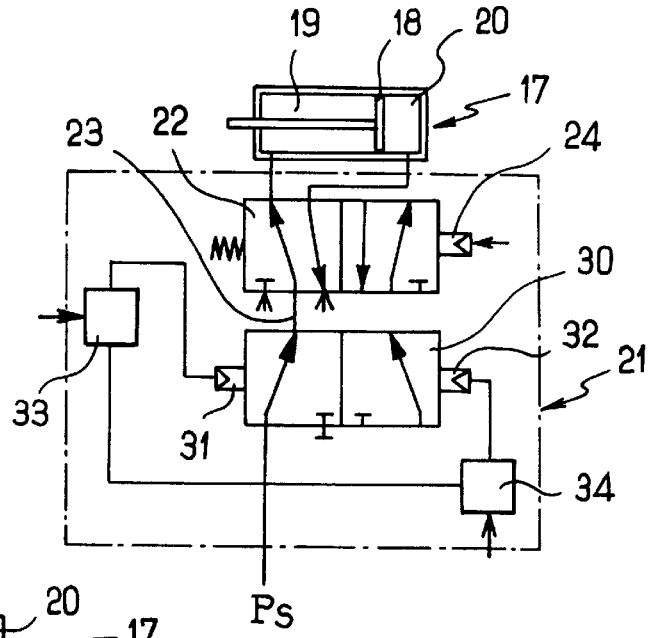

With reference to FIG. 3, in the second implementation, the control member 21 comprises a bistable valve 30 disposed between a source of air at tightening pressure PS and the feed inlet 23 of a valve 22 that is identical to the valve 22 of the first implementation. The valve 30 is controlled by two control inlets 31 and 32 to move between a feed position in which the source of air at tightening pressure PS is connected to the feed inlet 23, and a feed shutoff position in which the source of air at tightening pressure PS is shut off. The control inlet 31 of the valve 30 is connected to a timer element 33 and the control inlet 32 is connected to a timer element 34, both timer elements being connected to the pressure source PS.

Before beginning a screwing cycle, the control member 21 is in the position shown in FIG. 3, i.e. the valve 22 at rest provides a connection between the feed inlet 23 and the return chamber 19, while the valve 30 provides a connection between the pressure source PS and the feed inlet 23. When the spindle passes through a first position relative to the structure, a cam simultaneously triggers action on the control inlet 24 of the valve 22 and starts the timers 33 and 34. The control applied to the valve 22 causes the chamber 20 to be fed with fluid at the tightening pressure PS, thereby causing the tightening spindle to rotate. At the end of a time period T1, the timer element 34 acts on the control inlet 32 of the valve 30 to bring it into its feed shutoff position. Feed to the chamber 20 is then interrupted and the piston 18 continues to move at decreasing speed by the air that is contained in the chamber 20 expanding.

At the end of a time period T2, greater than T1, which defines the end of the prior step, the timer element 33 acts on control inlet 31 of the valve 30 to return it to its feed position. Air at the tightening pressure PS is then again admitted into the chamber 20 so that the required tightening torque is applied to the stopper.

Because the feed to the actuator is interrupted during the time interval T1 to T2, the mean differential pressure on the piston during the prior step is less than the tightening pressure. T1 and T2 are determined so as to guarantee that a sufficient quantity of air is admitted into the chamber 20 to ensure that the stopper is almost completely tightened at the end of time period T2, and that the speed of the spindle at that time is small enough to ensure that the corresponding kinetic energy when the stopper comes into abutment generates dynamic torque that is less than the torque generated by the tightening pressure. Reconnecting the chamber 20 to the tightening pressure PS then causes tightening to take place at low speed so that when the spindle stops rotating, the required tightening torque has been reached, but not exceeded.

When the spindle reaches an end-of-cycle position, the valve 22 is put into the rest position and the tightening pressure PS is sent into the chamber 19 of the actuator so as to cause it to retract. The chuck device 6 is caused to release the stopper and the spindle is ready for a new cycle.

Figure 4:
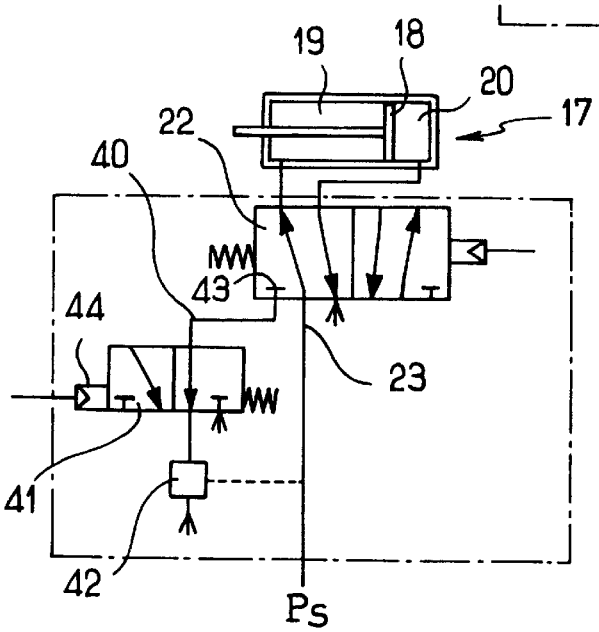

With reference to FIG. 4, and in a third implementation, the feed inlet 23 of the valve 22 is connected directly to a source of air at the tightening pressure PS. An exhaust duct 40 extends between a monostable valve 41 and an outlet 43 from the valve 22 corresponding to exhaust from the chamber 19 when the valve 22 is in the screwing position.

The valve 41 is controlled by an inlet 44 to move between a rest position in which the duct 40 is connected to an exhaust regulator member 42, itself controlled by the pressure PS, and a regulated exhaust position in which the duct 40 is allowed to exhaust freely. The control inlet 44 of the valve 41 is connected to a position sensor 50 for sensing the position of the rack 16. The position sensor 50 is disposed so as to correspond with the end of a stopper being screwed prior to the stopper being tightened.

When the spindle passes through a first position relative to the structure, the valve 22 is moved into the screwing position so that air at tightening pressure PS is admitted into the chamber 20 while exhaust from the chamber 19 is subjected to the exhaust regulation member 42. The face of the piston 18 looking into the chamber 20 is thus subjected to the tightening pressure PS while the opposite face of the piston 18 is subjected to a counter-pressure that results from the restriction on exhaust as exerted by the regulation member 42. The difference between the pressure and the counter-pressure is adjusted by means of the regulation member 42 so as to ensure there is no danger of the screwing spindle racing.

When the rack 16 reaches the sensor 50, the sensor actuates the control inlet of the valve 41 so that it occupies the non-regulated exhaust position, thereby leaving exhaust from the chamber 19 free. The piston 18 is then subjected to the tightening pressure PS and the required tightening torque is applied to the stopper.

Naturally the invention is not limited to the embodiment described and various embodiments can be provided without going beyond the ambit of the invention as defined by the claims.

In particular, although the valve control inlets are described above with reference to specific means for controlling them, any control means can be used that are appropriate in the installation under consideration for defining a prior step during which the piston 18 is subjected to reduced mean differential pressure and a final step in which it is subjected to the full tightening differential pressure.

Although the second implementation described above has tightening pressure PS applied once only during time period T2, tightening pressure or some other constant pressure can be applied on a plurality of occasions during time period T2 in the form of pulses of duration that is appropriate for the type of packaging or the type of stopper in question.

Although the invention is described with reference to a spindle that is rotated by a linear actuator, thereby making it possible to obtain tightening torque which is directly proportional to the feed pressure, it is also possible to implement the method of the invention with a fluid-fed motor in which the motor member is associated with the spindle shaft via a torque limiter device, e.g. a rotary motor fitted with a friction clutch. Under such circumstances, the method of the invention makes it possible to avoid the tightening torque being exceeded by the torque limiter device triggering inertia relative to the kinetic energy stored by the motor.

What is claimed is:

1. A method of controlling a screwing spindle including a singe fluid-fed motor connected to a single drive member, said single drive member being connected to a spindle shaft to cause it to rotate, the method comprising a first step of feeding the motor under conditions of pressure and flow rate for producing a speed of rotation of the spindle shaft low enough for generating a kinetic energy that can not produce a torque greater than a nominal tightening torque regardless of a duration of this step and, a second step in which the feeding conditions of pressure and flow rate of said single motor produce a torque equal to the nominal tightening torque.

2. A method according to claim 1, wherein the motor is a linear actuator and the drive member is a piston, and wherein, in the prior step, the piston is subjected to a mean differential pressure that is less than a tightening differential pressure.

3. A method according to claim 2, wherein, in the prior step, one face of the piston is subjected to a constant pressure in the screwing direction.

4. A method according to claim 3, wherein the constant pressure is less than the tightening differential pressure.

5. A method according to claim 3, wherein the piston is subjected to a counter-pressure.

6. A method according to claim 5, wherein the constant pressure is equal to the tightening differential pressure.

7. A method according to claim 2, wherein, in the prior step, the piston is subjected to pressure intermittently.

8. A method according to claim 7, wherein the pressure is a differential pressure of constant value equal to the tightening differential pressure.

* * * * *